US005497588A

United States Patent [19]

Martin et al.

[11] Patent Number: 5,497,588

[45] Date of Patent: Mar. 12, 1996

[54] WINDOW APPARATUS AND METHOD FOR A GARAGE DOOR

[75] Inventors: David O. Martin, Salt Lake City; Robert S. Scott, Provo, both of Utah

[73] Assignee: Martin Door Manufacturing, Inc., Salt Lake City, Utah

[21] Appl. No.: 226,503

[22] Filed: Apr. 12, 1994

[51] Int. Cl.[6] ..... E06B 3/00

[52] U.S. Cl. ..... 52/208; 52/476; 52/786.1

[58] Field of Search ..... 52/208, 204.61, 52/211, 455, 476, 784, 788, 803, 809, 811, 825, 820, 745.19; 160/201, 236, 237

[56] References Cited

U.S. PATENT DOCUMENTS 3,855,994 12/1974 Evans et al. ..... 52/208 X 4,856,575 8/1989 Wells ..... 52/208 X 5,283,995 2/1994 Richter ..... 52/208 X

*Primary Examiner*—Creighton Smith

*Attorney, Agent, or Firm*—J.Winslow Young

[57] ABSTRACT

A decorative overlay and window system for an opening in a garage door, the decorative overlay including a peripheral framework formed as an integral part of the decorative overlay. Bolt strips having a plurality of bolts extending outwardly therefrom are secured to the inner face of the peripheral framework. The bolts provide an alignment mechanism for aligning the decorative overlay with the opening in the garage door. A windowpane having a plurality of holes in its border is mounted to the peripheral framework by passing the bolts through the holes and then threadedly fastening nuts to the bolts. An insulation liner is provided to cover open edges of adjacent insulation in the event the decorative window system is used on an insulated garage door.

18 Claims, 3 Drawing Sheets

WINDOW APPARATUS AND METHOD FOR A GARAGE DOOR

BACKGROUND

1. Field of the Invention

This invention relates to windows for garage doors and, more particularly, to a decorative window system having a decorative overlay and an anchor mechanism for mounting both the decorative overlay and a windowpane directly over an opening in the garage door. The system requires fewer components and is easier to install and replace.

2. The Prior Art

The most widely used garage doors are those assembled from a series of door sections aligned horizontally in an edge-to-edge configuration to form a vertically oriented door for the garage opening. The sections are hinged together as a series along their abutting, horizontal edges to allow the garage door to be raised upwardly in a track to an overhead, horizontal position. The track includes a curved section between the vertical and the overhead positions. The hinged sections allow the garage door to traverse this curved section during the transition of the garage door from the vertical to the overhead, horizontal position.

A somewhat recent innovation in garage doors has been the inclusion of a series of decorative windows incorporated usually in the upper section of the garage door. These windows are formed in individual panels of the upper section and provide daylight illumination of the closed garage. A window opening is formed in each panel. Conventionally, a rather cumbersome window and window framework system is then inserted in the opening. Referring specifically to FIG. 1 (Prior Art) this prior art window is shown generally at 10 in the environment of a fragmentary portion of a garage door section 12 having an opening 14 cut therein. It is into opening 14 that prior art window 10 is placed. Garage door section 12 is shown in a simplified, stylized form in order to more clearly illustrate this invention. In particular, garage door section 12 is shown as having a planar face whereas in the art, garage door section 12 almost always includes some form of a decoratively embossed or bas-relief surface. This surface treatment is not shown herein for ease of presentation although it does provide important decorative and structural functions. Decoratively, this surface treatment is designed to mimic conventional wood panels while structurally it imparts a certain degree of dimensional stability to garage door section 12.

In this illustration of prior art window 10, an exterior frame 16 is inserted into opening 14 after which a decorative overlay 18 is mounted in an exterior frame 16 followed by a windowpane 20 of glass or plastic. Exterior frame 16 is mounted to garage door section 12 while decorative overlay 18 and windowpane 20 are retained in exterior frame 16 by a plurality of clips 22*a*–22*d*. Clips 22*a*–22*d* are conventional devices and configured with a generally U-shaped cross section having a series internally located, longitudinal ridges that are designed to engage corresponding longitudinal ridges 17 on the peripheral lip of exterior frame 16. Clips 22*a*–22*d* are designed such that the edges of the U-shaped cross section are resiliently urged together thereby enabling clips 22*a*–22*d* to securely engage longitudinal ridges 17 of the peripheral lip of exterior frame 16. This feature requires that a hammer must be used to force clips 22*a*–22*d* into engagement with exterior frame 16. Once engaged, clips 22*a*–22*d* are very difficult to remove in the event any component of prior art window 10 requires replacement and, even if removed, experience has shown that clips 22*a*–22*d* are usually irreparably damaged during the removal process.

The number of components that constitute prior art window 10 means that it is difficult to assemble as well as to disassemble. Also, the increased costs involved with the various components along with the labor required for its assembly limit its universal application for all garage door installations. Another important factor with regard to prior art window 10 is that it must be mounted into garage door section 12 before garage door section 12 is assembled into the completed garage door. Garage door section 12 is place on a padded surface and the various components of prior art window 10 are mounted thereto. The final step of the mounting procedure requires clips 22*a*–22*d* to be vigorously pounded into place using a heavy mallet. This is why a padded surface is used during the mounting procedure.

However, perhaps one of the greatest deterrents to its acceptance is that of appearance, not of the window, per se, but due to the appearance of the lack of professionalism. This poor appearance arises from two factors, the first of which is inherent in the plastic from which the exterior frame 16 and decorative overlay 18 are fabricated. In particular, the four side elements that constitute exterior frame 16 are produced from a plastic that is suitable for extrusion whereas the plastic material from which decorative overlay 18 is fabricated is a sheet of plastic material suitable for being shaped by being thermoformed over a rigid mold. Ordinarily one would assume that the plastic base material from which each of these components are fabricated would be identical although this is most unlikely since each thermoforming application for a plastic base requires slight variations in the formulation of the plastic base. Further, the sources of the various plastic base materials could be produced by entirely different manufacturers. The end result is that, over time, a noticeable difference in appearance will emerge between exterior frame 16 and decorative overlay 18, since each type of plastic will weather differently especially under the harsh effects of the ultraviolet portion of the sun's spectrum.

Clearly, the foregoing problem may not manifest itself for a period of years; however, perhaps the second problem associated with prior art window 10 is the most troublesome. This problem is simply one of the dimensional integrity of prior art window 10. Specifically, even minor variations in the alignment between exterior frame 16 and decorative overlay 18 are especially noticeable to even the casual observer so that the overall appearance of prior art window 10 is that of unprofessionalism. The same problem is encountered when viewing prior art window 10 interiorly in that clips 22*a*–22*d* not only sag and twist but are notoriously difficult to fit with a precision, ninety-degree fit at the abutting corners of clips 22*a*–22*d*, especially when clips 22*a*– 22*d* must be vigorously hammered into place.

In view of the foregoing, it would be an advancement in the art to provide a garage door window system having a unitary exterior frame and decorative overlay. It would also be an advancement in the art to provide a garage door window system that is characterized by the absence of clips to accommodate easy replacement of the window. Such a novel garage door window system is disclosed and claimed herein.

BRIEF SUMMARY AND OBJECTS OF THE INVENTION

This invention is a novel, decorative window system for a window opening in a garage door wherein an integral framework and a decorative overlay are formed as a unitary insert to which the windowpane is bolted directly to hold the unitary insert against the opening. Bolts are mounted to strips glued to the unitary insert. The bolts also serve to initially align the unitary insert with the opening in the garage door and to hold this alignment to accommodate one-person installation of the window into an assembled garage door. This invention also includes an optional insulation liner for the garage door window system, the insulation liner serving as a framing system for those garage doors that are insulated. The insulation liner is bolted to the garage door atop the window pane.

It is, therefore, a primary object of this invention to provide improvements in garage door window systems.

Another object of this invention is to provide improvements in the method of installing a decorative window in a garage door.

Another object of this invention is to provide a unitary framework and decorative overlay for a garage door window.

Another object of this invention is to provide a bolt strip for the unitary framework and decorative overlay so that the windowpane can be bolted directly to the unitary framework and decorative overlay, the windowpane holding the unitary framework and decorative overlay to the garage door.

Another object of this invention is to provide the bolts in the bolt strips as an alignment system for aligning the unitary framework and decorative overlay over the opening in the garage door.

Another object of this invention is to provide an insulation liner for insulated garage doors, the insulation liner being configured to be bolted to the unitary framework and decorative overlay along with the windowpane.

These and other objects and features of the present invention will become more readily apparent from the following description in which preferred and other embodiments of the invention have been set forth in conjunction with the accompanying drawing and appended claims.

DETAILED DESCRIPTION OF THE PREFERRED EMBODIMENT

Figure 1:
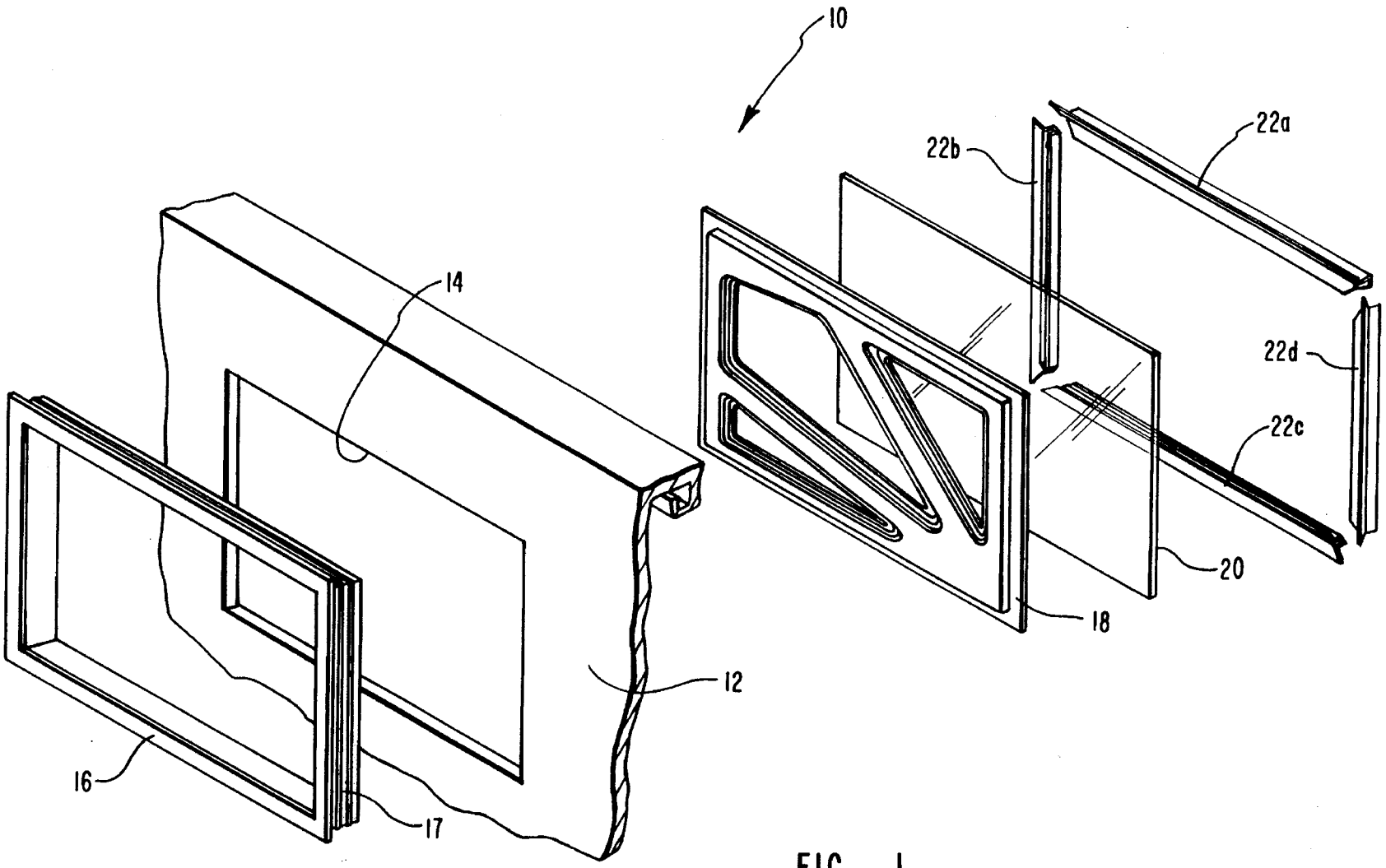
FIG. 1 (PRIOR ART)
FIG. 1 (Prior Art) is an exploded, perspective view of prior art decorative window system for a garage door shown in the environment of a fragmentary portion of a garage door.

The invention is best understood by the following description in conjunction with the appended claims and with reference to the drawing wherein like parts are designated by like numerals throughout.

Figure 2:
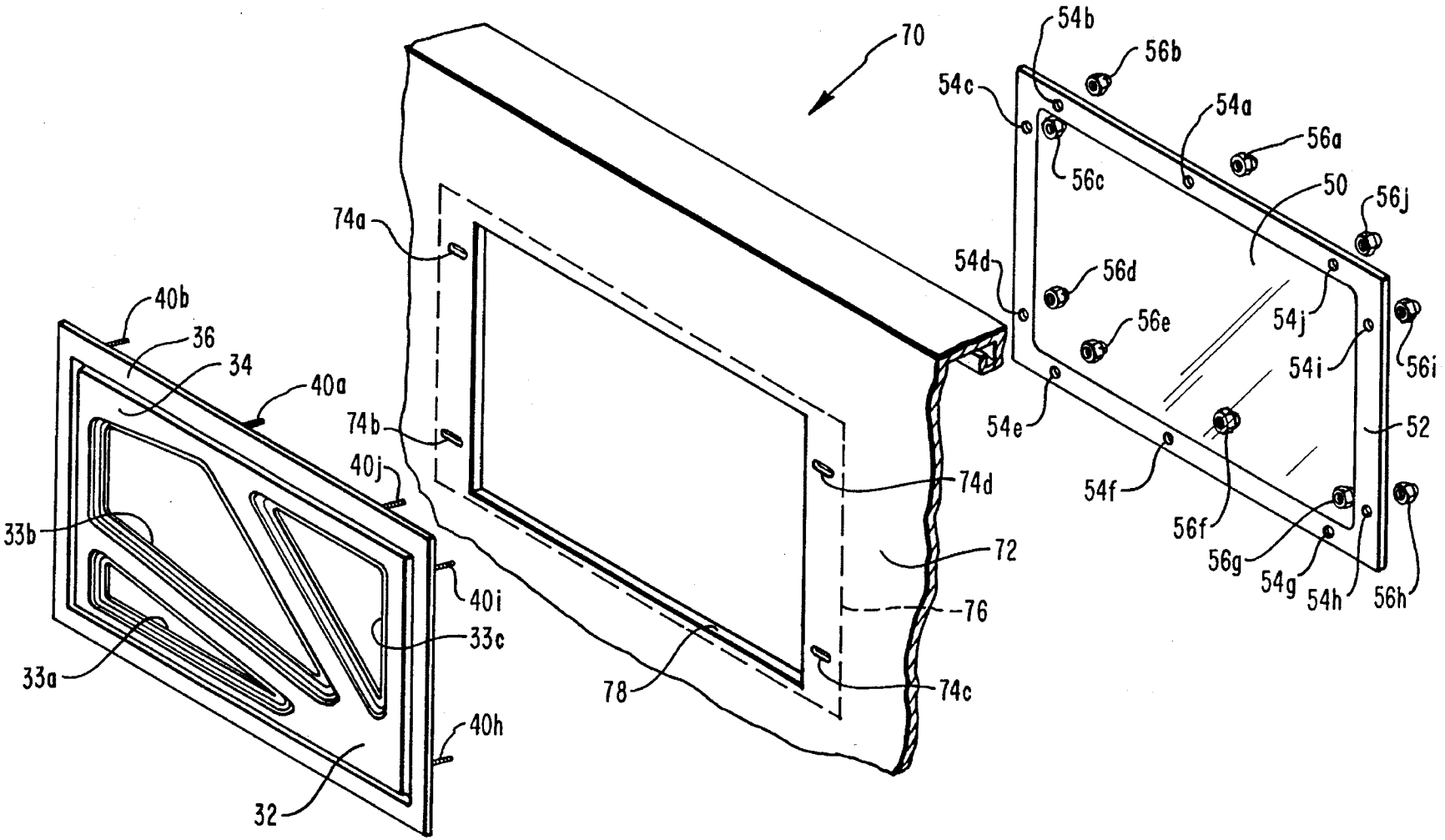
FIG. 2 is an exploded, perspective view of the novel, decorative window system of this invention shown in the environment of a fragmentary portion of a garage door.

Referring now more particularly to FIG. 2, the novel, decorative window of this invention is shown generally at 70 and includes a unitary insert 32 and a windowpane 50. Decorative window 70 is shown in the environment of a garage door section 72 having an opening 78 therethrough. Unitary insert 32 includes a decorative overlay portion 34 with an integral framework 36 formed coextensively around the periphery of decorative overlay portion 34. Decorative overlay portion 34 is configured with a plurality of geometric openings 33*a*–33*c* each of which is formed with a predetermined geometric profile to lend a pleasing visual appearance to unitary insert 32. Customarily, a series of unitary inserts 32 are mounted across separate openings 78 in garage door section 72 with each set of geometric openings 33*a*–33*c* coordinated along the length of garage door section 72 to present a pleasing overall appearance to decorative window 70.

Importantly, all of unitary insert 32, including both decorative overlay portion 34 and integral framework 36, is fabricated from a single sheet of plastic, metal, or the like, using conventional forming techniques. Fabrication of unitary insert 32 from a single sheet of material eliminates entirely the problems inherent in having these two elements fabricated from different plastic batches or even different types of plastic entirely. Particularly important is the fact that all of unitary insert 32 will experience identical weathering effects and thus unitary insert 32 will continue to have a pleasing appearance over a longer period of time. Another advantage to having unitary insert 32 fabricated as a single unit is that it completely eliminates any dimensional differences between decorative overlay portion 34 and integral framework 36 which would otherwise be inherent if these two items were manufactured separately as shown in FIG. 1 (Prior Art). Unitary insert 32 is configured to be mounted to the face of garage door section 72 to cover opening 78 cut therethrough. The dimensions of opening 78 are incrementally smaller than the external dimensions of unitary insert 32 so that the external periphery of unitary insert 32 resides entirely on the face of garage door section 72 as shown by the dashed line 76.

Figure 3:
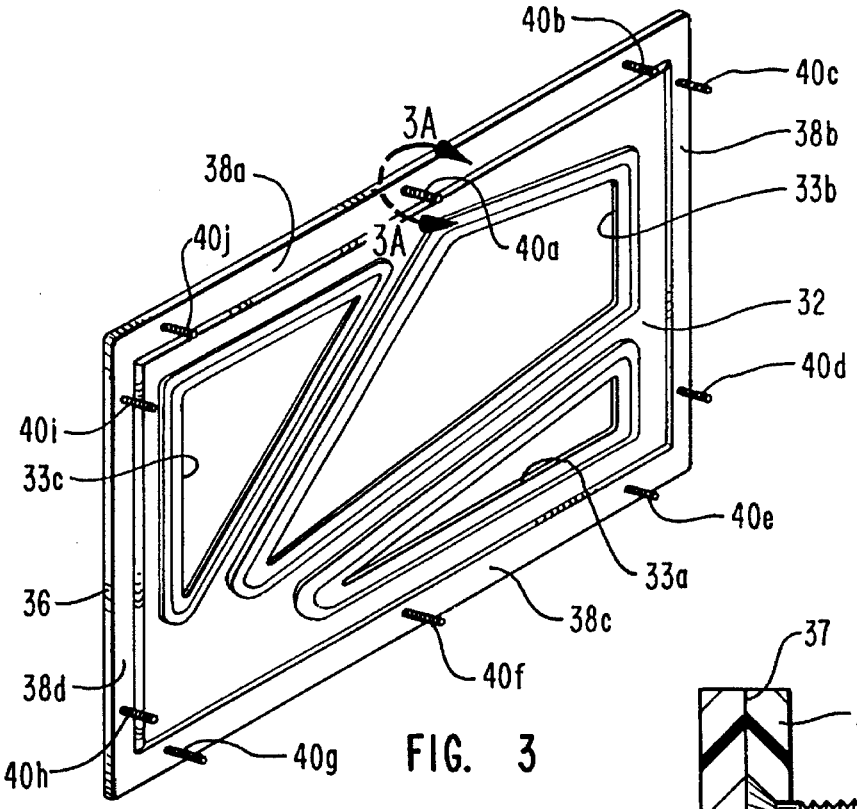
FIG. 3 is a perspective view of the underside side of the unitary insert showing the bolt strips glued to the underside of the unitary insert.
Figure 3A:
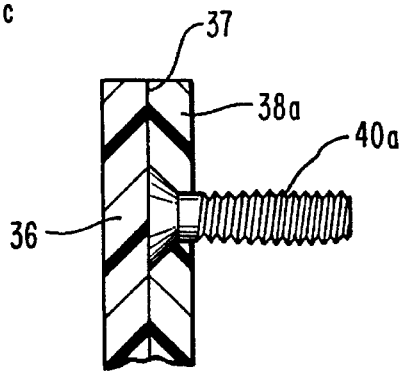
FIG. 3A is an enlarged, fragmentary, cross-sectional view of a bolt in the bolt strip glued to the unitary insert.

Referring now to FIG. 3, the reverse side of unitary insert 32 is shown and includes a plurality of bolt strips 38*a*–38*d* affixed to unitary insert 32 underneath integral framework 36. Referring also to FIG. 3A, an enlarged, fragmentary portion of bolt strip 38*a* is shown tightly bonded to the inner face of integral framework 36 by a glue surface 37. A bolt 40*a* is embedded in bolt strip 38*a* and extends outwardly therefrom. Bonding bolt strip 38*a* to integral framework 36 mounts bolt 40*a* directly thereto in a secure fashion. Bolt strips 38*a*–38*d* serve to mount a plurality of bolts 40*a*–40*j* to unitary insert 32 in a permanent orientation.

Referring again also to FIG. 2, bolts 40*a*–40*j* are mounted to integral framework 36 in a predetermined spatial orientation specifically configured to enable bolts 40*a*–40*j* to align unitary insert 32 relative to the periphery of opening 78. Further, garage door section 72 includes two pairs of opposed holes at each end of opening 78, holes 74*a* and 74*b* on the left and holes 74*c* and 74*d* on the right. The placement of holes 74*a*–74*d* is dimensionally configured to receive bolts 40*c*, 40*d*, 40*h*, and 40*i*, (FIG. 3) respectively, therethrough. This unique feature eliminates all further positioning, etc., of unitary insert 32 relative to garage door section 72. The remainder of bolts 40*a*, 40*b*, 40*e*–40*g*, and 40*j* pass through opening 78 adjacent the respective edges of opening 78. Bolts 40*c*, 40*d*, 40*h*, and 40*i* provide a holding mechanism for holding unitary insert 32 in place on garage door section 72 while garage door section 72 is in a vertical orientation. This feature allows a single installer (not shown) to mount decorative window 70 to garage door section 72 even after garage door section 72 has been assembled into the completed garage door (not shown). This uniquely enables the installer to provide to the customer (not shown) with any one of a selection of decorative styles of unitary insert 32 and types of windowpane 50.

Windowpane 50 is shown herein as a transparent sheet of plastic having a border 52 silk screened thereon. Advantageously, the color of border 52 can be coordinated to match the color of the interior of garage door section 72. Border 52 includes a plurality of holes 54*a*–54*j* therethrough, the spatial orientation thereof corresponding to that of bolts 40*a*–40*j*, respectively. Holes 54*a*– 54*j* allow windowpane 50 to be mounted directly to the inner face of unitary insert 32 with the peripheral edge of garage door section 72 surrounding opening 78 clamped therebetween. Advantageously, border 52 provides an interior frame for windowpane 50 when windowpane 50 or, more particularly, decorative window 70 is viewed from the inside of garage door section 72.

A plurality of locknuts 56*a*–56*j* are affixed to bolts 40*a*–40*j*, respectively, to securely engage windowpane 50 to unitary insert 32 while simultaneously engaging the peripheral edge of opening 78 between integral framework 36 and border 52. Replacement of either or both of unitary insert 32 and/or windowpane 50 is accomplished by removal of lock nuts 56*a*–56*j* and replacement of the respective element.

Figure 4:
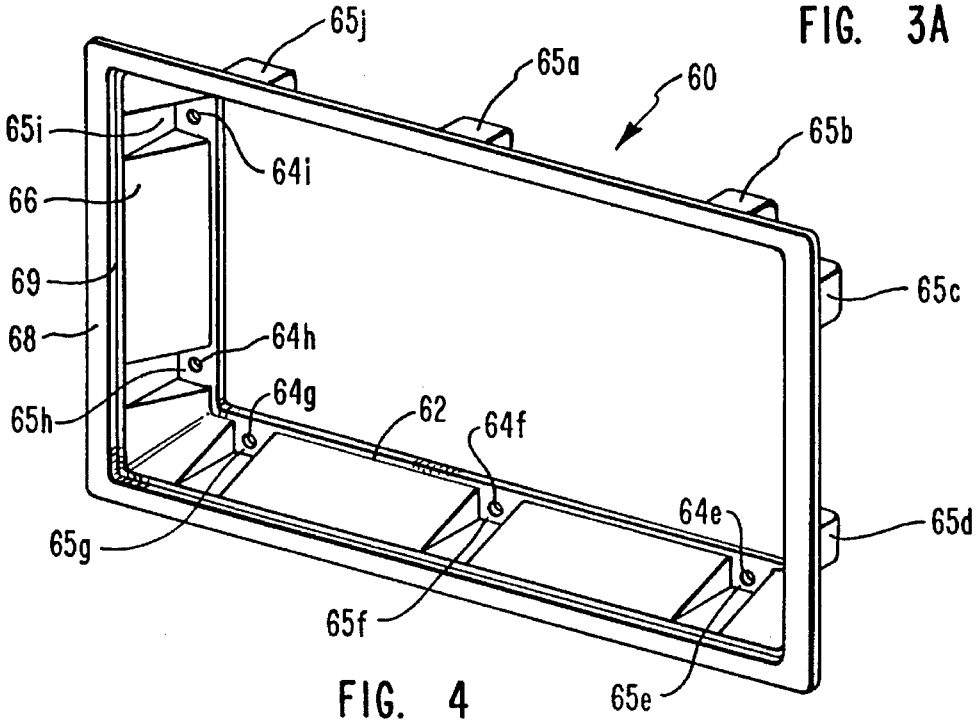
FIG. 4 is an insulation liner for use on an insulated garage door, the insulation liner being configured to be bolted atop the windowpane.

Referring now to FIG. 4, an insulation liner 60 is shown having an inner frame 62 the dimensions of which correspond to the inner periphery of border 52. Inner frame 62 also includes a plurality of holes therethrough only a portion of which are shown herein as holes 64*e*–64*i* the spacing of which dimensionally corresponds to bolts 40*e*–40*i* and holes 54*e*–54*i* in border 52, respectively. A raised, slanted sidewall 66 surrounds inner frame 62 and encloses the insulation (not shown) mounted to the inside face of garage door section 72 (FIG. 2). Slanted sidewall 66 forms a diagonal brace for insulation liner 60. Recesses 65*a*–65*j* are formed in slanted sidewall 66 to provide a surface for holes 64*a*–64*d* and 64*j* (hidden) for bolting insulation liner 60 against windowpane 50. Slanted sidewall 66 imparts a degree of dimensional stability to insulation liner 60 relative to inner frame 62. Slanted sidewall 66 in combination with recesses 65*a*–65*j* are formed by being molded simultaneously from the material of construction of insulation liner 60. Recesses 65*a*–65*d* and 65*j* are illustrated from the underside while recesses 65*e*–65*i* are shown on the upper side. Slanted sidewall 66 terminates peripheral ledge 69 and an outwardly extending flange 68 which serves to provide a finished appearance to insulation liner 60.

Insulation liner 60 is configured to be mounted to the inner face of garage door section 72 with inner frame 62 bolted against border 52 of windowpane 50 by bolts 40*a*–40*j* passing through holes 54*a*–54*j* in windowpane 50 and corresponding holes 64*a*–64*j* in insulation liner 60. Lock nuts 56*a*–56*j* are then used to secure inner frame 62 against border 52 and unitary insert 32. This relationship forms a window well configuration with insulation liner 60 thereby providing an aesthetically pleasing appearance to the interior of garage door section 72 when it is insulated with an insulative layer (not shown). Otherwise, the edges of the insulative layer surrounding unitary insert 32 would be exposed to view both from the inside and from the outside of garage door section 72.

Peripheral ledge 69 forms a receiving surface for supporting the peripheral edge of a second windowpane (not shown) in the event it is desired to provide a double glazing for the novel decorative window 70 of this invention. Double glazing is accomplished by applying a bead of adhesive along peripheral ledge 69 followed by adhering the periphery of the second windowpane thereto.

The Method

The method of this invention is practiced by preparing unitary insert 32 including decorative overlay 34 and integral framework 36 from a single sheet of material. Next, bolt strips 38*a*–38*d* having bolts 40*a*–40*j* secured thereto are mounted to the underside of integral framework 36. The placement of bolts 40*c*, 40*d* and 40*h*, 40*i* therein are selectively predetermined to serve as an alignment mechanism along with holes 74*a*–74*d*, respectively, for aligning unitary insert 32 in opening 78. Windowpane 50 is prepared from a sheet of plastic material having the desired characteristics whether pebbled, clear, smoked, colored, or the like. Border 52 is silkscreened around the periphery of windowpane 50. Holes 54*a*–54*j* are drilled through border 52 with the spatial relationship of holes 54*a*–54*j* being selectively predetermined to correspond to the spatial orientation of bolts 40*a*–40*j*. Unitary insert 32 is mounted to the exterior surface of garage door section 72 while windowpane 50 is mounted to the inside surface thereby clamping the periphery of opening 78 between these two elements. Lock nuts 56*a*–56*j* are then mounted to bolts 40*a*–40*j* to thereby securely mount decorative window 70 including windowpane 50 to garage door section 72. In the event the inner surface of garage door section 72 is insulated with an insulative layer (not shown) insulation liner 60 is also mounted to bolts 40*a*–40*j* over the top of windowpane 50 before lock nuts 56*a*–56*j* are attached to bolts 40*a*–40*j*, respectively.

In the event it becomes necessary or desirable to change either unitary insert 32 or windowpane 50, it is a simple matter to remove all of lock nuts 56*a*–56*j* and then replace one or both of these items. This procedure is substantially easier to perform than when using the prior art system shown in FIG. 1 (prior art).

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A decorative window system in a garage door comprising:

a unitary insert comprising a decorative overlay and an integral framework formed as a continuous element with said decorative overlay, said integral framework having dimensions configured to frame an opening in the garage door;

a plurality of bolt strips mounted to an inner face of said integral framework;

a plurality of bolts mounted to said bolt strips and extending perpendicularly from said integral framework;

a windowpane having a border and a plurality of holes in said border, said holes corresponding to said bolts mounted to said bolt strips; and a plurality of nuts for threadedly engaging said bolts to secure said windowpane to said unitary insert.

2. The decorative window system defined in claim 1 wherein said bolts comprise an alignment means for aligning said unitary insert with the opening in the garage door.

3. The decorative window system defined in claim 2 wherein said alignment means comprises a plurality of spaced holes in the garage door adjacent the opening.

4. The decorative window system defined in claim 1 wherein said border of said windowpane is prepared with a color to match said unitary insert.

5. The decorative window system defined in claim 1 wherein said decorative window system includes an insulation liner for enclosing the edges of a layer of insulation on the garage door adjacent said decorative window system.

6. The decorative window system defined in claim 5 wherein said insulation liner comprises an inner frame dimensionally corresponding to said border of said windowpane, said inner frame including a plurality of holes dimensionally corresponding to said plurality of bolts for mounting said insulation liner to said windowpane and said unitary insert, said insulation liner further comprising a slanted sidewall extending outwardly from the periphery of said inner frame, said slanted sidewall terminating in a peripheral ledge and an outwardly extending rim, said raised sidewall forming a window well for said decorative window system and thereby enclosing exposed edges of the insulative layer.

7. The decorative window system defined in claim 6 wherein said insulation liner includes a plurality of recesses in said slanted sidewall, said recesses providing surfaces for each of said holes in said inner frame.

8. A decorative window system in a garage door comprising:

a decorative overlay having a peripheral framework formed as an integral part of said decorative overlay, said decorative overlay and said peripheral framework having an inner face and an outer face, said inner face being oriented toward the interior of the garage door and said other face being oriented toward the exterior of the garage door;

mounting means for mounting said decorative overlay and said peripheral framework over an opening in the garage door with said peripheral framework framing the edges of the opening;

alignment means on said peripheral framework for aligning said peripheral framework with the opening;

a windowpane for said decorative overlay; and attachment means for attaching said windowpane to said decorative overlay, said windowpane being mounted to the inside of the garage door with said decorative overlay on the exterior of the garage door.

9. The decorative window system defined in claim 8 wherein said mounting means comprises a plurality of bolt strips affixed to said inner face of said peripheral framework, said bolt strips comprising plastic strips having a plurality of bolts mounted thereto in a preselected spatial orientation.

10. The decorative window system defined in claim 9 wherein said bolts comprise said alignment means for aligning said peripheral framework with the opening.

11. The decorative window system defined in claim 8 wherein said attachment means for attaching said windowpane to said decorative overlay comprises a border on said windowpane, said border dimensionally corresponding to said peripheral framework and having a plurality of holes therethrough, said holes spatially corresponding to said bolts to accommodate said windowpane being mounted to said decorative overlay with said bolts passing through said holes, Said attachment means including a plurality of nuts for threaded engagement with said bolts.

12. The decorative window system defined in claim 8 further including an insulation liner for enclosing exposed edges of an insulative layer on the inside surface of the garage door, the exposed edges surrounding the opening in the garage door, said insulation liner comprising an inner frame dimensionally corresponding to said peripheral framework and having a slanted sidewall around said inner frame, said slanted sidewall terminating in a peripheral ledge and an outwardly extending rim.

13. The decorative window system defined in claim 12 wherein said insulation liner comprises a plurality of recesses around said inner frame and in said slanted sidewall, said recesses having been deformably constructed from the material of said insulation liner.

14. A method for mounting a decorative window system in a garage door comprising the steps of:

preparing a decorative overlay for said decorative window system and forming a peripheral framework for said decorative overlay as an integral part of said decorative overlay, said peripheral framework dimensionally corresponding to the periphery of an opening in the garage door;

mounting a plurality of bolts to said peripheral framework, said bolts having a predetermined spatial orientation;

forming a windowpane for said decorative window system by forming a border around said windowpane and preparing a plurality of holes in said border, said holes spatially corresponding to said bolts;

attaching said decorative overlay over the opening in the garage door with said peripheral framework outlining the opening in the garage door;

securing said windowpane to said peripheral framework by mounting said holes in said border over said bolts; and affixing said windowpane to said peripheral framework by threadedly engaging nuts to said bolts.

15. The method defined in claim 14 wherein said affixing step comprises replacing at least one of said decorative overlay and said windowpane by removing said nuts from said bolts.

16. The method defined in claim 14 wherein said mounting step comprises affixing said plurality of bolts to a plurality of bolt strips and securing said bolt strips to said peripheral framework, said bolt strips providing said predetermined spatial orientation.

17. The method defined in claim 14 wherein said securing step comprises mounting an insulation liner to said windowpane, said insulation liner comprising a raised sidewall for enclosing the edges of an insulative layer adjacent the opening in the garage door.

18. The method defined in claim 17 wherein said mounting step includes stiffening said raised sidewall by forming said raised sidewall with a slanted surface and terminating said slanted surface in a peripheral ledge and an outwardly extending rim.

* * * * *